United States Patent [19]

Khalid et al.

[11] Patent Number: 5,019,221

[45] Date of Patent: May 28, 1991

[54] ELECTROPLATING DRUM CATHODE WITH HIGH CURRENT-CARRYING CAPABILITY

[75] Inventors: Joseph M. Khalid; Chakrakody V. Shastry, both of East Windsor, N.J.

[73] Assignee: Yates Industries, Bordentown, N.J.

[21] Appl. No.: 298,120

[22] Filed: Jan. 18, 1989

[51] Int. Cl.[5] ..... C25D 1/04; C25D 17/00

[52] U.S. Cl. ..... 204/13; 204/216

[58] Field of Search ..... 204/13, 216

[56] References Cited

U.S. PATENT DOCUMENTS

| | | | |
|---|---|---|---|
| 2,051,928 | 8/1936 | Yates | 204/216 |
| 2,646,396 | 7/1953 | Dean | 204/12 |
| 3,461,046 | 8/1969 | Clancy | 204/216 |
| 3,674,656 | 7/1972 | Yates | 204/216 |
| 4,240,894 | 12/1980 | Adler | 204/208 |

*Primary Examiner*—T. M. Tufariello

*Attorney, Agent, or Firm*—Finnegan, Henderson, Farabow, Garrett, & Dunner

[57] ABSTRACT

A drum cathode for the production of metal foil, the drum having a titanium top cylinder and a stainless steel base cylinder integrallly connected by welding (1) a niobium or vanadium ring to the top cylinder, (2) a copper ring to the niobium or vanadium ring, and (3) the base cylinder to the copper ring, so as to provide a high electric current carrying path between the top and base cylinder. The drum cathode eliminates the formation of "hot spots" during use, while permitting increased electric current flow and foil product rate.

12 Claims, 2 Drawing Sheets

ELECTROPLATING DRUM CATHODE WITH HIGH CURRENT-CARRYING CAPABILITY

FIELD OF THE INVENTION

This invention relates to the electrolytic production of metal foil. More particularly, this invention relates to a drum cathode for use in the production of copper foil by the electrodeposition of copper from an electrolyte onto the surface of a drum having a titanium surface.

BACKGROUND OF THE INVENTION

With the growth of the electronics industries over the last two decades the use of electrodeposited copper foil in integrated circuit boards, which are used in computers and other electronic products, has assumed increasing importance. The copper foil used for such purposes must be of very high quality, of uniform thickness, smooth and free from surface imperfections.

The electrodeposition of a metal on a rotating drum cathode from a metal-containing electrolyte to produce a thin metal foil on the surface of the drum has been in use for many years. For example, U.S. Pat. No. 3,674,656 discloses an electrochemical process for the manufacture of copper foil for use in the preparation of printed circuit boards. The process uses a drum cathode which rotates partially immersed in a body of copper sulfate electrolyte adjacent to a pair of concentric anodes. Typically, the anodes, which are insoluble, are made of lead, lead-antimony, platinized titanium or oxides of iridium and ruthenium. The top, or outer, surface of the drum is typically made of stainless steel, titanium, or stainless steel plated with chromium. Often times, the drum is constructed of, for example, a titanium top sheet, or cylinder, over an underlying, or supporting, base cylinder of a less expensive metal in order to reduce costs.

As the drum cathode rotates in the electrolyte, an electrodeposit of copper forms on the outer surface of the drum. The electrodeposited copper is stripped from the surface of the rotating drum in the form of a thin foil. In such a process, the amperage used directly determines the amount of copper electrodeposited on the cathode.

In the past, much effort has gone into improving the equipment used for the production of electrodeposited thin metallic foils, especially copper foil. Much of this effort concentrated on the development of improved-performance drum cathodes. Since the side of the foil next to the drum's outer surface replicates the surface on which it forms, it is important that the outer surface of the drum be smooth and free from cracks and the like. Therefore, drums capable of maintaining a smooth surface have been sought. This is because unless one starts with a raw foil (as it comes off the drum) of suitable quality, no treatment, no matter how good, can transform the foil into a satisfactory product.

The primary features of a good drum with a good outer, or plating, surface are as follows:

1. Good corrosion resistance, especially on the plating surface;
2. Good surface finish with good adhesion and foil stripping characteristics;
3. Capability of carrying high electric current (for high output);
4. Efficiency in making porosity-free and defect-free foil;

5. Ability to produce uniform thickness of foil across the complete drum width;
6. Low labor and low cost maintenance; and
7. Other requirements such as availability of components, machinability, non-toxicity, cost effectiveness, and the like.

These requirements, and particularly those involving the drum surface, lead inevitably to the development of a titanium drum. The copper foil industry initially utilized a lead drum. The corrosion rate of the drum surface in sulfuric acid was, however, so high that the drum surface had to be "brushed" continuously. In order to solve this corrosion problem, foil manufacturers experimented with and used stainless steels, chromium, chromium-plated stainless steels, titanium and its alloys, and, less commonly, zirconium in the drum surface. Titanium has received the most attention and acceptance and is disclosed as the cathode material in U.S. Pat. No. 2,646,396. Indeed, titanium comes close to meeting all the requirements of an ideal drum-surface material. It has excellent corrosion resistance to sulfuric acid in the relevant range of acid concentration (10–20%) and temperature (120°–200° F.), is commercially available, machineable, and non-toxic, has good copper foil stripping/adhesion properties, requires low maintenance, produces a non-porous defect-free foil with a fine matte surface finish, and finally, its electrical conductivity, while not excellent, is better than that of stainless steel.

Despite this impressive set of desirable "material" properties, titanium drums in the electrodeposited copper foil industry were found to suffer from serious problems. "Hot spots" would appear on the drum surface and within days or weeks cause it to fail and severely limit its productive life. A detailed account of the history of titanium drum development and "hot spot" problem is disclosed in U.S. Pat. No. 4,240,894.

Another serious but related problem with titanium drums has been a limitation on the current density they can carry, the maximum current density being about 350 amperes per square foot. This, for a given drum size, limited the total current the drum could carry which, in turn, placed a corresponding limit on the drum's output capacity of metal foil as expressed in weight per unit of time. When this current density was exceeded the drum was found to become readily prone to the development of hot spots and, consequently, it had a short life.

During the course of investigating the formation of hot spots and consequent premature failure of prior art titanium drum cathodes, I have developed the following understanding of this phenomenon, which, in turn, has permitted me to develop the present invention as a solution to the above problems which have plagued the industry for many years.

It has been the practice in industry to build titanium drum cathodes as a cylindrical underdrum formed of a less expensive metal with a concentric titanium top sheet, or cylinder, directly over it. In such a drum cathode, the electrical and thermal connections, their stability and their cross sections are a major focus of the present invention.

Previously, the causes of hot spots were not understood and, therefore, the prior art proposed solutions to this problem which were not effective to eliminate the formation of hot spots during use. It was perceived that very high mechanical forces coupling the titanium top cylinder, or sheet, of the drum to the underdrum, or base sheet, directly below it would prevent hot spots from developing. To obtain these high coupling forces the underdrum was made of a material that combined high electrical conductivity with ductility and a high linear temperature coefficient of expansion (LTCE) compared to that of titanium. The titanium top cylinder had an inside diameter slightly smaller than the outside diameter of the underdrum (supporting cylinder), and the top cylinder was heated and shrink-fitted over the underdrum. This method is disclosed in U.S. Pat. No. 3,461,046 and, with some modifications, in U.S. Pat. No. 4,240,894.

The above shrink fitting method is, in principle, a scheme that relies on mechanical force to make electrical contact between two surfaces. There is, however, a distinction between an "actual" and an apparent contact surface. A book on a table gives a simple illustration of the two quantities. The apparent contact surface, in this case, would be the area defined by the product of the width of the book's cover multiplied by its length. If the book's cover happens to be 9"×12", the apparent contact area between the book and the table would be 108 square inches. The two surfaces in contact are, however, not perfectly flat and smooth. Therefore, the actual contact surface is made up of a collection of very small spots scattered over the apparent contact surface and which, when added all together, represent a small fraction, perhaps one percent, of the apparent contact area. The exact value of this actual contact surface depends on the hardness of the book cover, the hardness of the table top on which it rests, and the force pressing these two objects against each other. If both the book and the table were infinitely hard, they could touch on three small spots. However, since all materials are deformable to some degree, one finds that as the loading force is increased on the book, the initial contact spots become larger and new contact spots come into being. Up to a certain limit, when the loading force on the book is removed, both surfaces are restored to their initial condition and no permanent deformation has taken place on either surface. The range of mechanical loading force through which no permanent deformation occurs, is called the "elastic range". If the loading force is increased beyond this range, permanent deformation of one or both contact surfaces occurs and the deformation is said to be of the "plastic type".

When two "apparently" flat bodies come into contact under some mechanical load, some of the actual contact spots undergo elastic, and others plastic deformation. This is because on the scale of these contact spots, these nominally flat contact surfaces are neither flat nor even and, consequently, some spots bear more load than others, putting the more loaded ones in the plastic range.

The above-described principle also applies to an equivalent one foot square segment of a titanium top sheet shrink-fitted on its supporting portion of the base drum. Therein, the apparent contact interface of one square foot exists between these two metallic members, but there is a much smaller actual contact surface which bears all the loading force. This actual contact surface is made up of a collection of small isolated peaks, or contact spots, some which are elastically deformed and others of which are deformed plastically. A contact spot is clearly established when a peak of one member interfaces with the other surface. If an electric current were to pass through such an interface, it would see an overwhelmingly large insulating area where there is no contact between the members, with the isolated contact spots appearing as tiny conducting islands. The importance of this phenomenon in relationship to the present invention will be seen from the following discussion.

The typical dimension of a contact spot is of the order of one or two mils or less (1.0 mil equals 0.001"). These dimensions are determined by calculations using simplified models, as well as by measuring a quantity called (electrical) "constriction resistance", Rc. This quantity can be explained by referring to FIG. 1 depicting two imaginary cylinders J and K having their end surfaces finished as hemispheres which act as a pair of electric contacts and touch only at one contact spot. An electric current is passed from J to K in the direction of the arrows and is represented in the drawing by the series of lines. The lines of current are axial, uniform and straight except in the "constriction region" shown bounded by the two dashed lines. Within the constriction regions M, two phenomena are observed that contribute further instability to the contact spot as an electrical contact.

First, the lines of current have to bend to go through the contact spot which results in a longer path for the current to travel and, therefore, contributes an added resistance, known as construction resistance. The smaller the contact spot in relation to the diameter of the cylinders, the greater is the constriction resistance, which is several times larger than the bulk resistance of that portion of the conductor which contains the constriction.

Most of the heat flux from J to K, or vice versa, is carried thru the contact spot. A general rule that applies to metallic conductors is: heat flux and electric current are carried predominantly by the same electrons and, therefore, along the same path. This fact adversely affects the stability of these contact spots.

The second phenomenon associated with the above constriction is the appearance of an "electrodynamic blow-out force". This force tends to blow the contact members apart. Referring to FIG. 1, this force acts to push cylinder J up and cylinder K down, with the net effect of reducing the contact force, which increases the constriction resistance, increases the Joule heat $I^2Rc$, and makes the contact spot unstable. This force is encountered in all high current applications where current constriction takes place, or where current has a horizontal component parallel to the contact surface. In such a case the current sees a perpendicular magnetic field component which results in this force. The magnitude of the electrodynamic blow-out force is proportional to the square of the electric current passing thru the contact spot (constriction) and inversely proportional to the size of the spot.

A central fact relating to the prior art titanium drum cathode designs which use the shrink-fitting method to generate contact forces between top and base cylinders is that the size of the individual contact spots is too small compared to the axial thermal expansions and contractions of the top and base cylinders. For example, consider a typical drum: 60 inches wide, with a shrink-fitted titanium top cylinder, and a copper or stainless steel base cylinder. If this drum is taken from a room temperature ambient of 70° F. and placed in a plating solution at 160° F., there is a very large differential in thermal expansion between the top cylinder and the base cylinder. The temperature coefficients of linear expansion (TCLE), for titanium and copper are $4.6\times10^{-6}$ and $9.2\times10^{-6}$ inches per inch per degree F., respectively. Therefore, the copper base cylinder will expand axially by $60\times9.2\times10^{-6}\times90=0.04968$ inches. The titanium cylinder on the other hand will expand by $60\times4.6\times10^{-6}\times90=0.02484$ inches, which is nearly half the expansion of the base and about an order of magnitude larger than the size of the average contact spot.

This means that every time the drum is taken out of production, or put back in, most of the previous set of contact spots are replaced with a new set. Due to constriction resistance and the spot's small thermal inertia, the typical contact spot runs considerably hotter than the bulk material and is, therefore, at least partly oxidized. But, the oxidation process is accelerated following each thermal expansion or contraction, as this process exposes a freshly heated and unoxidized portion of a contact spot to air. If such a spot becomes a contact point in a subsequent expansion or contraction it would be more oxidized than the time before, its constriction resistance would be greater and it would operate at a higher temperature. If this contact spot survives the first expansion or contraction, its chances to survive the next would thus be diminished. This sequence of events occur in a "thermal runaway" situation.

As more and more of these contact spots are eliminated and become insulators, the remaining ones are left to operate at a higher current density. This, in turn, increases the blow-out forces, the operating temperature and the rate of oxidation, causing yet further deterioration of the remaining spots. When, due to this attrition of contact spots, the current density at the surviving spots exceeds a critical value, hot spots appear and failure of the drum follows in short order. In drums having a titanium top cylinder, this sequence of events, culminating in drum failure, has commonly occurred over a span of several months, limiting the drum life to less than a year.

Previously proposed solutions, as disclosed in U.S. Pat. Nos. 3,461,946 and 4,240,894, in the form of a base cylinder, or underdrum, made out of a material with higher LTCE than titanium failed to compensate for the resulting axial direction instability of the contact surfaces. In fact, these proposals, while helping the radial instability, made the axial instability worse.

Mild steel has been used for the underdrum because it has a higher LTCE than titanium. The use of this metal, however, introduces yet further undesirable complications. One such undesirable effect is the extra heat generated by eddy currents in the steel base sheet. Although, normally eddy currents are not a problem in direct current applications, they are in this application because the drum cathode rotates and only the immersed segment of the drum carries current. These factors produce a rate of change of magnetic flux which induces a certain EMF (electromotive force) in the steel base which, in turn, produces the eddy currents. These eddy currents and the heat they produce increase with current and the speed of rotation of the drum. The drum's speed, on the other hand, is keyed to the value of load current and the gauge of electrodeposited foil being produced.

Even higher contact pressure than provided by the shrink fitting technique has been proposed. In U.S. Pat. No. 4,240,894 there is proposed a series of raised portions on the supporting base drum thus presenting a smaller load bearing area. This might postpone, but will not reverse, the inevitable drum failure, because it does not solve the basic problem of contact spot instability as shown in the above analysis. Furthermore, the contact force between the titanium cylinder and the base cylinder, or supporting drum, is useful only up to the elastic limit irrespective of the source of the force. Beyond the elastic limit any additional force is dissipated through the production of plastic deformation and will not thus contribute any increase to the contact force.

There have also been proposals for introducing a soft sheet of copper or lead between the top titanium cylinder and the base cylinder. Such proposals are based upon the idea that a relatively soft and ductile metallic sheet would continuously deform to maintain "good contact" between the top titanium cylinder and the base cylinder. Not only does this arrangement fail to recognize and solve the basic instability problem, but it actually introduces an additional contact interface with the same problems. In fact, with this arrangement, one would have two constriction resistances in series: one between the titanium cylinder and the ductile sheet and the other between the ductile sheet and base cylinder.

The foregoing analysis and observed field experience lead me to the conclusion that a titanium drum design that relies on the shrink-fitting scheme or any source of mechanical force to provide an "electric contact" to carry suitable high currents between the titanium cylinder and base drum is an unstable, unreliable and low output design.

The present invention was developed as the result of efforts to produce an alternative titanium drum cathode construction free of the above problems and capable of operating at high currents up to and even exceeding 100 kiloamps (KA).

The primary object of the present invention is to provide an improved and reliable titanium drum cathode which has a titanium top cylinder on a supporting base cylinder which has a long service life free from the formation of hot spots.

Another object of the present invention is a drum cathode which has an increased current carrying ability and permits an increased rate of copper foil production.

Still another object of the present invention is an improved drum cathode which, when used in the production of copper foil permits, the foil to be produced with a minimum of surface imperfections and a more uniform weight distribution.

Additional objects and advantages of the present invention will be set forth in part in the description which follows, and in part will be obvious from the description or may be learned by practice of the present invention. The objects and advantages of the invention may be realized and attained by means of the instrumentalities and combinations particularly pointed out in the appended claims.

SUMMARY OF THE INVENTION

To achieve the objects and in accordance with the purpose of the present invention as embodied and broadly described herein, there is provided a drum cathode for use in electroplating which comprises: a base cylinder having first and second ends; a titanium top cylinder on the outer surface of the base cylinder, said top cylinder having first and second ends each adjacent a corresponding end of said base cylinder; and a ductile electrical connection means of high current-carrying capacity integrally connecting each of the corresponding ends of the top cylinder and the base cylinder and extending circumferentially around each of the ends. The electrical connection means preferably includes a first connecting element formed of niobium or vanadium joined to the top cylinder by a continuous welded connection and a second connecting element formed of copper joined to the first connecting element by a continuous welded connection, the second connecting element being also joined to the base cylinder by a continuous welded connection, whereby there is provided a continuous electric current carrying path of high current carrying capacity between the top cylinder and the base cylinder. The drum cathode further includes one or more side sheets joined to the base sheet circumferentially by a welded connection.

These welds and their materials are chosen so that the welds are ductile, stable and have high electrical and thermal conductivities and cross sections so as to be capable of carrying a high electrical current.

In one preferred embodiment of the present invention, the drum cathode further includes a third titanium connecting element joined to each of the top cylinder and the first connecting element by welded connections. Advantageously, the first and second connecting elements, preferably rings of substantially rectangular cross-section, are positioned on the inner surface of a portion of the base cylinder overhanging the drum's side sheet and the third connecting element, preferably a ring of substantially rectangular cross-section, is positioned on the inner surface of an overhanging a portion of the top cylinder overhanging the base cylinder, at each outer end of the cylindrical drum cathode.

In the most preferred embodiment of the present invention, a seamless commercially pure titanium top sheet is placed over a stainless steel base sheet.

The accompanying drawings, which are incorporated in and constitute a part of this specification, illustrate a preferred embodiment of the present invention and, together with the description, serve to explain the principles of the invention.

DESCRIPTION OF THE PREFERRED EMBODIMENT

Reference will now be made in detail to the present preferred embodiment of the invention, an example of which is illustrated in the accompanying drawings.

Figure 1:
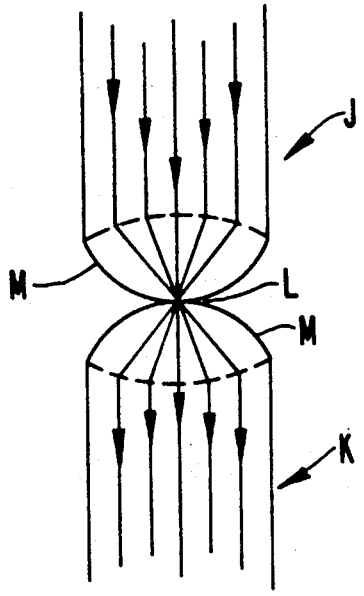
FIG. 1 diagrammatically illustrates the principle of constriction resistance in passing an electric current between two contact points.
Figure 2:
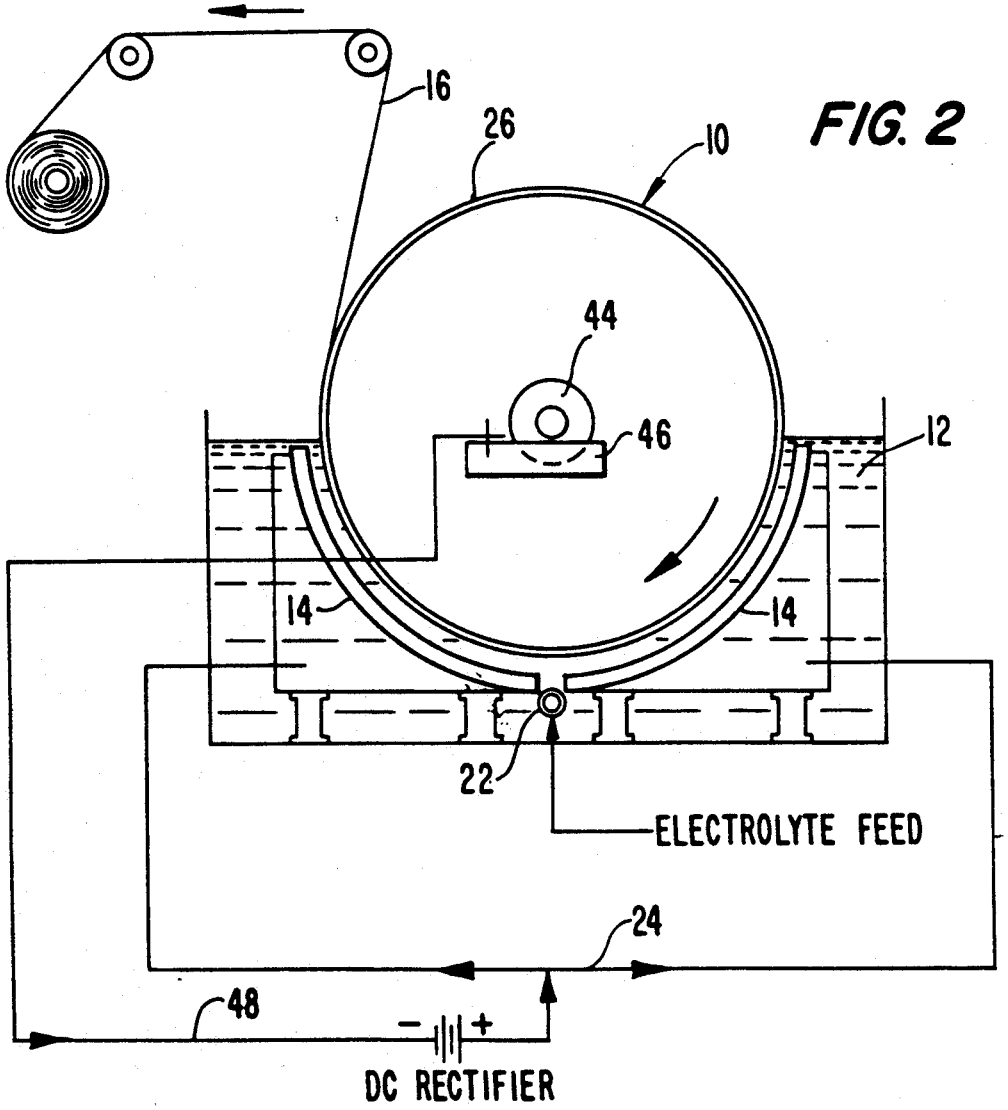
FIG. 2 is a schematic end view of apparatus for producing metal foil by electrodeposition on a drum cathode.

As shown in FIG. 2, a widely used process for the electrolytic production of copper foil involves the use of a drum cathode 10 which rotates partially immersed in an aqueous solution of copper sulfate electrolyte 12 adjacent a pair of curved, concentric insoluble anodes 14. As the drum 10 rotates in the electrolyte 12, an electrodeposit of copper forms on the drum cathode's top, or outer, surface and, as the latter leaves the electrolyte, the electrodeposited copper is stripped from the surface of the rotating drum in the form of a thin foil 16 which is then wrapped around a take-up roll 18.

The drum 10, electrolyte 12 and anodes 14 are held in a tank 20 and, typically, electrolyte feed from a dissolving tank is fed into tank 20 through a series of openings in feed conduit 22, or distributor, located near the bottom of tank 20 adjacent the gap between the anodes 14 and beneath drum cathode 10. The drum 10 is rotated by a shaft driven through gearing by an electric motor (not shown). Electric current of the desired amperage is provided by an appropriate source, for example, the positive terminal of a DC rectifer, and flows from buss bars 24 to each of anodes 14 through electrolyte 12 between anodes 14 and drum cathode 10 and copper from the electrolyte 12 is deposited on the outer surface of drum 10 in the form of a thin film. The amperage flowing through the system determine the amount of copper deposited on the surface of drum 10, and with the drum rotation speed, the two determine the thickness of the electrodeposited film.

Figure 3:
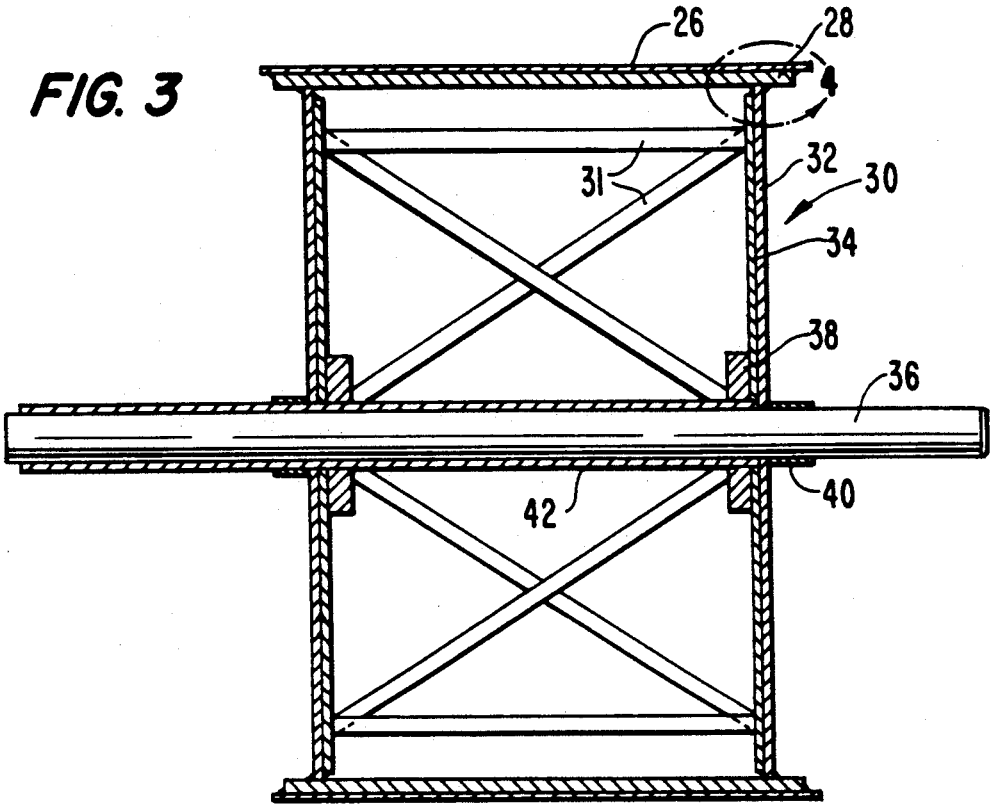
FIG. 3 is a front elevation, in section, of a drum cathode in accordance with the present invention, employed in the apparatus of FIG. 2.

Referring to FIG. 3, the electric current then passes through the top cylinder 26 to the base cylinder 28 and to each of the side sheets 30 near the outer ends of the base cylinder 28 and welded thereto. Internal bracing 31 may be provided, if desired, to provide the necessary rigidity to the drum. Preferably, each of the side sheets comprises an outer stainless steel side sheet 32, with an inner copper side sheet 34 placed on the inner surface thereof to provide enhanced electrical conductivity. The electric current then flows radially across the side sheets to a copper sleeve 42 over a shaft 36 which rotatably supports drum 10 through hubs 38 and steel shaft sleeves 40. The copper hubs 38 are positioned at each end of the drum and welded to the interior surface of side sheets 34. The copper sleeve 42 is fitted over shaft 36 and extends longitudinally on shaft 36 across the length of drum 10 where it is in electrical contact with each of copper side sheets 34 and extends to the drum exterior on the current collection side of the drum. Copper sleeve 42 conducts the current to a brush, or similar arrangement (not shown) which is in contact with contact block 46. Electric current is then passed from the contact block 46 to buss bars 48 to the negative terminal of the DC rectifier.

Figure 4:
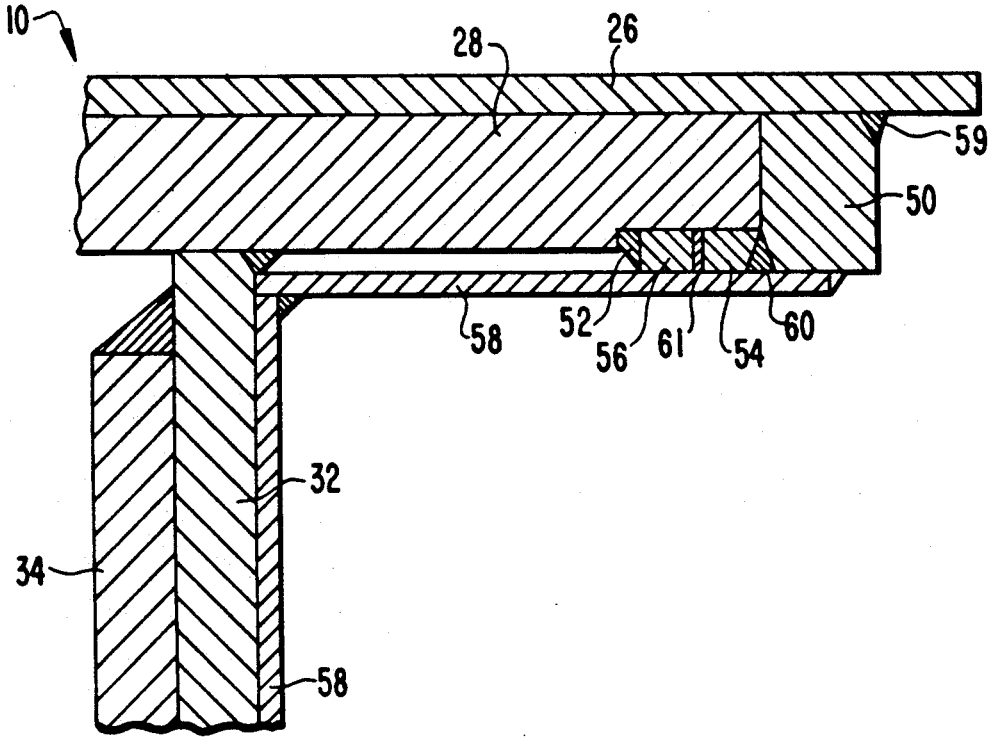
FIG. 4 is an enlarged detailed drawing, in section, of the encircled portion of the drum cathode shown in FIG. 3.

FIG. 4 illustrates a cross-sectional view of a portion of drum cathode 10, enlarged and in greater detail, at the upper right-hand corner of drum 10 shown in FIG. 2, that is, adjacent the junction of right hand side sheet 30 and base cylinder 28. As shown, top cylinder 26 is positioned on the outer surface of base cylinder 28. Both the top cylinder and the base cylinder are cylindrical in shape and form drum 10 which typically has an axial, or transverse, length of about 48 to about 60 inches and an outer circumference of about 22 to about 31 feet. The diameter of the outer surface of base cylinder 28 closely matches the diameter of the inner surface of top cylinder 26 which may be shrink-fitted over base cylinder 28 to provide a solid machinable surface. The transverse length of top cylinder 26 is greater than the transverse length of base cylinder 28, which in turn is greater than the transverse distance between the outer surfaces of side walls 32. Thus, the top cylinder overhangs each end of the base cylinder, which in turn overhangs each of the side sheets. Top sheet 26 circumferentially overhangs base sheet 28 by approximately 1⅜" on each end, and base sheet 28 circumferentially overhangs the outer surface of each of the side walls 32 by approximately 3⅜".

Base cylinder 28 is formed of stainless steel, for example, 304L stainless steel. Top cylinder 26 is formed of titanium, for example, ASTM Grade 1 titanium, or another suitable grade of titanium or titanium alloy. While the cylinder forming the titanium top cylinder 26 may be welded, with a weld seam extending across its transverse dimension, it is preferred that the top sheet is formed of a seamless cylinder of titanium. Such seamless top sheets have been found to produce copper foil having a more uniform surface, which is desired by users of the foil. The process of electrodeposition is characterized by extreme fidelity of replication. The surface characteristics of the foil are a mirror image of those of the drum surface on which the foil is produced. A seam on the surface of the top cylinder is replicated as a "seam" on the foil. While the copper in the foil "seam" is perfectly good functionally, most customers find it undesirable.

The inner surface of stainless steel base sheet 28 is undercut approximately $\frac{1}{8}$ inch over about a $\frac{7}{8}$ inch width adjacent each of its ends. A connecting titanium element 50, of the same composition as titanium top sheet 26, is positioned under the overhang abutting the underside of top sheet 26 and the outer end of base sheet 28 on each end of drum 10. Each of these titanium connecting elements 50, has a height slightly greater than the thickness of the base cylinder, and is a ring of generally rectangular cross-section which is integrally connected to titanium top cylinder 26 by a continuous welded connection extending completely around the circumference of drum 10 adjacent each of its ends. An annular groove 52 is thus formed in the undercut portion of base sheet 28 adjacent titanium connecting element 50.

Another connecting element, niobium ring 54, of generally rectangular cross-section and having a height approximately equal to the distance from the bottom surface of ring 50 to the bottom surface of the undercut on the base cylinder, is fitted into annular groove 52 inboard of titanium connecting element 50 to which it is integrally connected on the inboard side of titanium ring 50 by a continuous welded connection extending completely around the circumference thereof. Also located in annular groove 52 on the inboard side of ring 54 is still another connecting element, a generally rectangular cross-section copper ring 56 of the same height as ring 54, which is integrally connected to niobium ring 54 by a continuous welded connection, as well as being integrally connected to stainless steel base sheet 28 on the inboard wall of groove 52 by a continuous welded connection.

Connecting ring 54 preferably is made of niobium, although it has been determined that vanadium may also be satisfactorily welded to titanium ring 50 to make it integral therewith and provide a good electrically conductive path. When using niobium for ring 54 to be welded to titanium ring 50 commercially pure grade niobium and ASTM grade I titanium welding rod may be used. When using vanadium for ring 54, commercially pure grade vanadium and ASTM grade I titanium welding rod may be used for making the connection. Copper ring 56 may be joined to niobium ring 54 by using copper welding rod and may be joined to vanadium ring 54 by using copper welding rod. The copper ring 56 may be welded to steel base sheet 28 with copper welding rod. Other grades of copper, niobium, vanadium and welding rods may be used provided they have suitable electrical conductivity, ductility and welding characteristics.

The cross-section of each of titanium ring 50, niobium ring 54 and copper ring 56 should be large enough to satisfactorily carry a large electrical current without overheating. Similarly, the weldments used to join the rings to the top cylinder, the base cylinder and to each other should also be of a large enough cross-section to carry such current without overheating. Further, the weldments, most desirably, should be solid, that is free of gas and slag inclusions and should be well fused into the connecting elements and drum sheets to be joined so that an integral structure is provided. Typically, titanium ring 50 is of a rectangular cross-section, about $1\frac{1}{8}$ inch$\times\frac{3}{4}$ inch, niobium ring 54 is about $\frac{3}{8}$ inch$\times\frac{1}{4}$ inch and copper ring 56 is about $\frac{3}{8}$ inch$\times\frac{1}{4}$ inch.

As shown in FIGS. 3 and 4, base cylinder 28 is welded to side sheet 32 by a circumferential weldment at the underneath side of base cylinder 28 and the outside of sidesheet 32 to provide an integral connection. Copper side sheet 34, on the inside surface of stainless steel side sheet 32, is attached thereto by a circumferential weld around the periphery of side sheet 34.

It is also desirable to line the underside of the overhanging portions of base cylinder 28 and the outside surfaces of stainless steel side sheets 32 with a titanium shroud 58 to seal elements 52 and 54 from acid attack. The structure hereinabove described facilitates the installation of such shroud, in that titanium-to-titanium welds can be easily made.

During use of the drum cathode of the present invention illustrated in FIG. 4, the electric current flows from the electrolyte 12 through the top cylinder 26 to element 50 then to elements 54 and 56 and the base cylinder 28 and thence thru side sheet 32, to copper side sheet 34. The electric current will take the path of least resistance and the major portion of the electric current flowing from titanium top cylinder 26 will pass sequentially through the weld 59 to ring 50, through the weld joining ring 50 to ring 54, through weld 61 to ring 54 and the weld 60 joining ring 54 to ring 56, through ring 56 and through the weld 52 joining ring 56 to base sheet 28. The electric current will then pass transversely through base cylinder 28, through the weld joining the base sheet and stainless steel side sheet 32, across side sheet 32 and through the weld attaching copper side sheet 34 to side sheet 32 and through side sheet 34 to copper sleeve 42 which will carry the electric current from the drum as described earlier.

Of course, some of the electric current will also follow other paths. The drum construction described above has been found to be capable of carrying a sufficiently high amperage to prevent the formation of hot spots, while still operating at a very high level of current flowing in the system and at a very high foil production rate. It has been found that use of a drum cathode constructed as described hereinabove permits such a drum cathode to be used, without the formation of hot spots, during the drum's estimated lifetime of about 10–15 years, or longer, whereas the service life of drum cathodes with a titanium top cylinder joined to a steel base cylinder by the methods earlier discussed herein was typically limited to about 10–20 months before the drum had to be removed from service. Further, it has been demonstrated that drums of the same design operated successfully at currents of 45–50 KA, and designs have been made for 100 KA, so as to substantially eliminate restrictions on the current passed through the drum, with only other components of the electroplating apparatus limiting such current flow. Another important advantage of using the drum cathode described hereinabove is that the production of very thin copper foil, for example ½ ounce foil, is enhanced with a higher production rate of high quality thin foil made possible.

It will be apparent to those skilled in the art that various modifications and variations can be made in the drum cathode of the present invention without departing from the scope or spirit of the invention. Thus, it is intended that the present invention cover such modifications and variations of the invention provided they come within the scope of the appended claims and their equivalents.

What is claimed is:

1. A drum cathode for use in electroplating which comprises:

(a) a cylindrical base cylinder having first and second ends;

(b) a cylindrical titanium top cylinder on the outer surface of said base cylinder, said top cylinder having first and second ends each adjacent a corresponding end of said base cylinder; and (c) an electrical connection means of high ductility and high current-carrying capacity integrally connecting each end of said top cylinder and said base cylinder and extending circumferentially around said ends, said electrical connection means including at lest a first weldment comprising a metal capable of being welded to titanium and a second weldment capable of being welded to said base cylinder and wherein said first and second weldments are electrically connected.

2. The drum cathode of claim 1, wherein said electrical connection means further includes:

(a) a first connecting element formed of a metal capable of being welded to titanium connected to said top cylinder through said first weldment extending completely around the circumference of the drum; and (b) a second connecting element formed of a metal capable of being welded to said first connecting element joint to said first connecting element by a welded connection, said second connecting element being also joined to said base cylinder by said second weldment extending completely around the circumference of the drum, whereby there is provided a continuous electric current carrying path of high current carrying capacity between said top cylinder and said base cylinder.

3. The drum cathode of claim 2, wherein said base cylinder is formed of stainless steel, said first connecting element is formed on niobium or vanadium and said second connecting element is formed of copper.

4. The drum cathode of claim 3, further including one or more side sheets joined to said base cylinder circumferentially by a welded connection.

5. The drum cathode of claim 3, further including a third connecting element of titanium joined to each of said top cylinder and said first connecting element by welded connections.

6. The drum cathode of claim 5, wherein the transverse length of said base cylinder is greater than the transverse length of the core of said drum so there is provided a first circumferential overhang on each end of said base cylinder and wherein the transverse length of said top cylinder is greater than the transverse length of said base cylinder so there is provided a second circumferential over-hang at each end of said top cylinder, said first and second connecting elements being positioned on the under surface of said first overhang and said third connecting element being positioned on the under surface of said second overhang.

7. The drum cathode of claim 4, wherein said side sheet is stainless steel.

8. The drum cathode of claim 7, further including a titanium liner on the outer surface of said side sheet.

9. The drum cathode of claim 6, wherein an annular groove is formed near the periphery of said base cylinder adjacent said third connecting element and said first and second connecting elements are in the form of rings positioned in said groove.

10. The drum cathode of claim 1, wherein said titanium top cylinder is a seamless cylinder.

11. The drum cathode of claim 1, wherein said top cylinder is shrink-fitted over said base cylinder.

12. A process for producing metal foil by electrodepositing the metal foil on a drum cathode, wherein the metal foil is deposited on a drum cathode comprising:

(a) a cylindrical base cylinder having first and second ends;

(b) a cylindrical titanium top cylinder on the outer surface of said base cylinder, said top cylinder having first and second ends each adjacent a corresponding end of said base cylinder; and (c) an electrical connection means of high ductility and high current-carrying capacity integrally connecting each end of said top cylinder and said base cylinder and extending circumferentially around said ends, said electrical connection means including at least a first weldment comprising a metal capable of being welded to titanium and a second weldment capable of being welded to said base cylinder and wherein said first and second weldments are electrically connected.

* * * * *

UNITED STATES PATENT AND TRADEMARK OFFICE

CERTIFICATE OF CORRECTION

PATENT NO. : 5,019,221

DATED : May 28, 1991

INVENTOR(S) : Joseph M. Khalid and Chakrakody V. Shastry

It is certified that error appears in the above-identified patent and that said Letters Patent is hereby corrected as shown below:

Abstract, line 3, change "integrallly" to --integrally--.

Claim 1, column 11, line 27, change "lest" to --least--.

Claim 2, column 11, line 41, change "joint" to --joined--.

Signed and Sealed this

First Day of December, 1992

*Attest:*

DOUGLAS B. COMER

*Attesting Officer*

*Acting Commissioner of Patents and Trademarks*